US005772076A

United States Patent [19]

Juk et al.

[11] Patent Number: 5,772,076

[45] Date of Patent: Jun. 30, 1998

[54] HOT FILL DISPENSING CLOSURE

[75] Inventors: Steven Bernard Juk, Naperville; Leo R. Imbery, Jr., Aurora, both of Ill.

[73] Assignee: White Cap, Inc., Downers Grove, Ill.

[21] Appl. No.: 686,644

[22] Filed: Jul. 26, 1996

[51] Int. Cl.[6] ..... B67D 5/06

[52] U.S. Cl. ..... 222/153.06; 222/521; 222/541.6

[58] Field of Search ..... 222/153.06, 519, 222/520, 521, 541.6, 525

[56] References Cited

U.S. PATENT DOCUMENTS

| | | | |
|---|---|---|---|
| 2,104,413 | 1/1938 | Cahoon | 222/521 |
| 2,591,231 | 4/1952 | Boadway | 222/521 |
| 2,619,265 | 11/1952 | Jacobsohn | 222/521 |
| 2,969,168 | 1/1961 | Newby | 222/525 |
| 2,998,902 | 9/1961 | Thomas et al. | 222/499 |
| 3,201,013 | 8/1965 | Porter et al. | 222/525 |
| 3,209,388 | 10/1965 | Kambersky | 15/521 |
| 3,572,559 | 3/1971 | Stull | 222/499 |
| 3,578,223 | 5/1971 | Armour | 222/521 |
| 3,834,596 | 9/1974 | Brady et al. | 222/520 |
| 4,967,941 | 11/1990 | Beck | 222/521 |
| 5,052,595 | 10/1991 | Mon | 222/525 |
| 5,104,008 | 4/1992 | Crisci | 222/153 |
| 5,110,017 | 5/1992 | Braun | 222/520 |
| 5,145,094 | 9/1992 | Perlmutter | 222/153 |
| 5,181,632 | 1/1993 | Latter | 222/153 |
| 5,328,063 | 7/1994 | Beck et al. | 222/524 |
| 5,456,374 | 10/1995 | Beck | 215/251 |
| 5,465,876 | 11/1995 | Crisci | 222/153.1 |
| 5,472,120 | 12/1995 | Stebick et al. | 222/153.06 |
| 5,501,377 | 3/1996 | Dubach | 222/521 |
| 5,588,562 | 12/1996 | Sander et al. | 222/541.6 X |
| 5,603,436 | 2/1997 | Leonvacallo et al. | 222/525 |
| 5,655,685 | 8/1997 | Carr et al. | 222/153.06 X |

*Primary Examiner*—Joseph Kaufman
*Attorney, Agent, or Firm*—Lockwood, Alex, Fitzgibbon & Cummings

[57] ABSTRACT

A dispensing closure which is particularly suited for hot fill packaging wherein vacuum conditions are present as well as the packaging of carbonated beverages wherein superatmospheric conditions are present. The dispensing closure includes a rotatable outercap that overlies, and is relatively moveable with respect to, an inner cap secured to a container mouth. The inner and/or outer cap can be integrally formed with a resilient thermoplastic gasket liner system that provides vacuum seals both between the inner or outer caps and container as well as between the inner and outer caps. The closure can be equipped with a tamper indicating band, preferably located at the base of the outer cap, which will separate from the outer cap when it is rotated and axially moved upwardly from the closed to the dispensing position.

68 Claims, 13 Drawing Sheets

FIG. 15
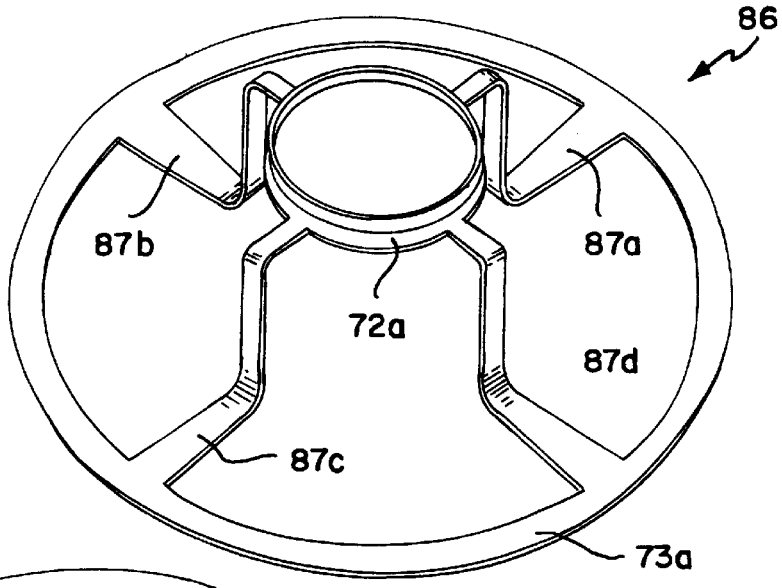
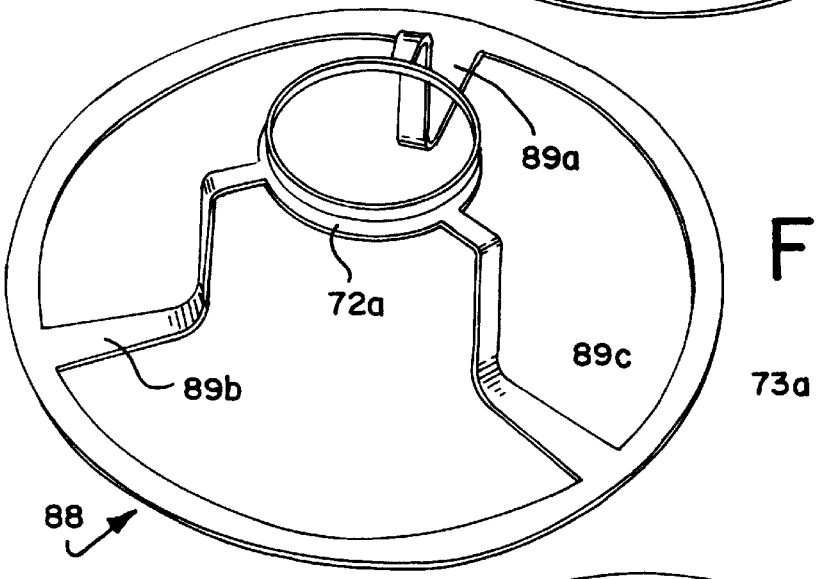
FIG. 16
FIG. 17
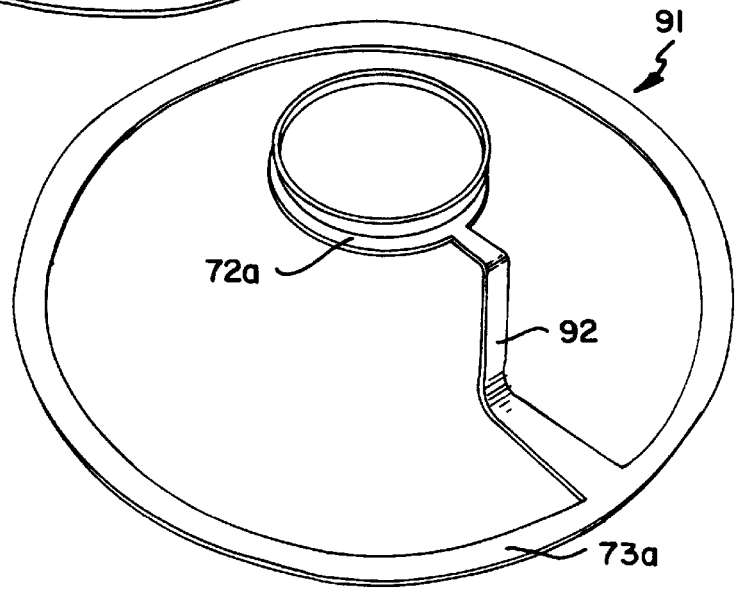

FIG. 19
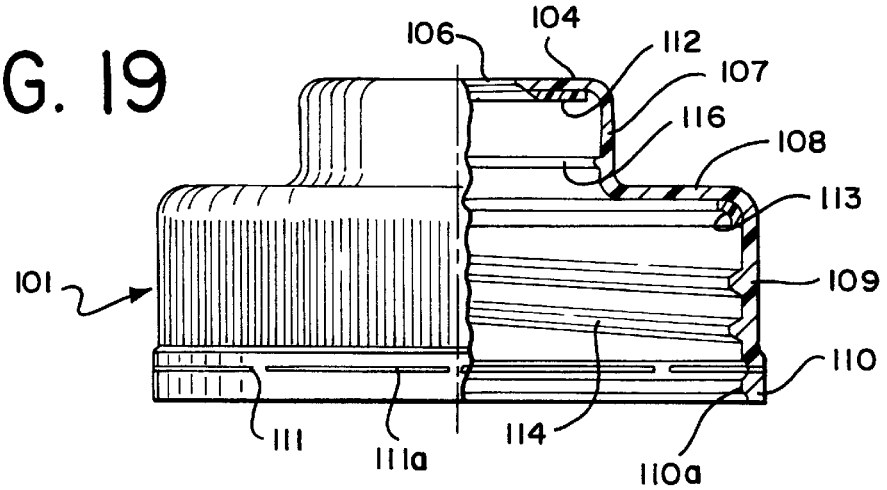
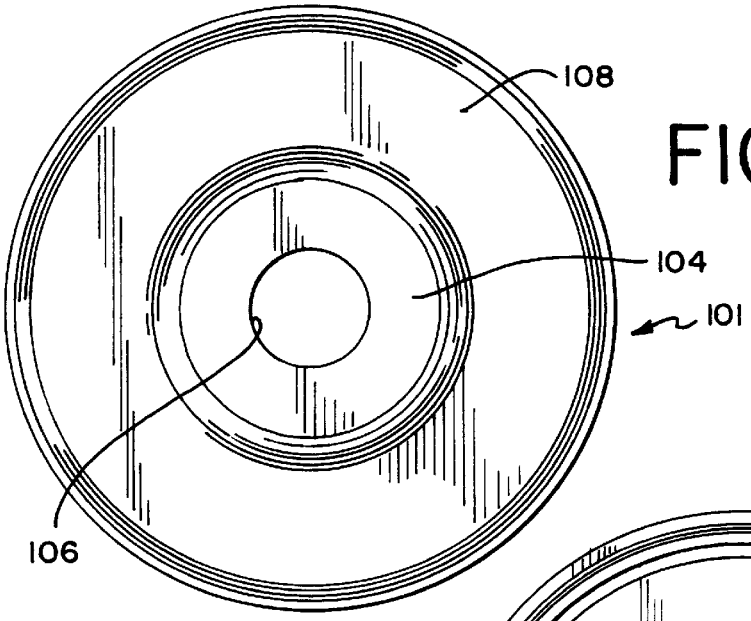
FIG. 20
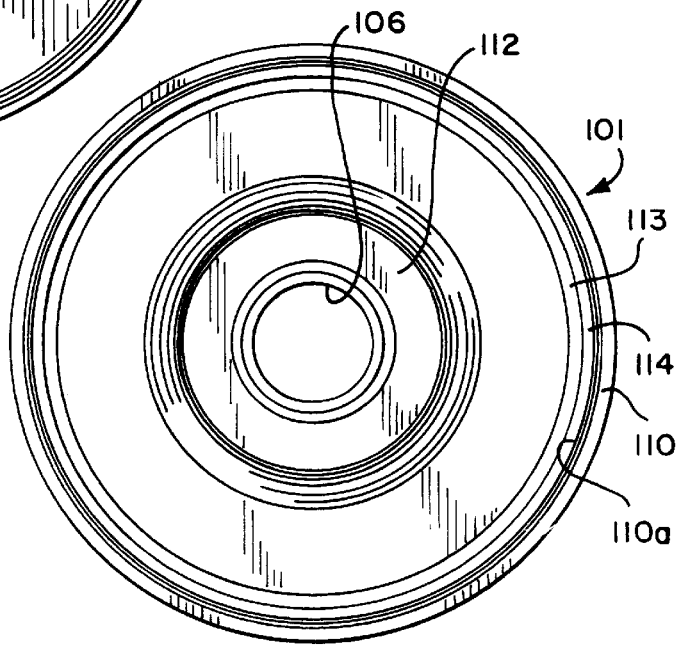
FIG. 21

HOT FILL DISPENSING CLOSURE

TECHNICAL FIELD OF THE INVENTION

The present invention generally relates to dispensing closures and, more particularly, is directed to dispensing closures which are particularly suited for hot fill packaging wherein vacuum conditions are present as well as the packaging of carbonated beverages wherein superatmospheric conditions are present. In this regard, an important aspect of this invention concerns a hot fill dispensing closure capable of providing a vacuum seal which closure incorporates both an inner cap and an outer cap that are relatively movable with respect to each other between a closed position and a dispensing position and wherein at least one of the inner and outer caps has an integral resilient liner system which cap and liner system are manufactured by a two material molding process.

BACKGROUND OF THE INVENTION

Most commercial dispensing closures commonly in use for hot fill packaging such as, for example, the packaging of perishable beverages, require the application of a heat sealed foil liner to the mouth of a container immediately following the filling thereof in order to achieve and maintain a vacuum in the container until the contents thereof are to be dispensed. Such foil liners are inconvenient because the closure must be removed in order to enable the heat sealed liner to be peeled off, following which the closure is then reapplied to the bottle.

Prior art patents directed to dispensing closures typically show structures which, for hot fill packaging, require such heat sealed foil liners. For example, U.S. Pat. No. 3,834,596 entitled "Bottle-Closure Structure" shows a dispensing closure that includes a washer-like element that is snap fitted into the mouth of a container. The washer-like element has a cylindrical conduit that extends upwardly to a level appreciably above the top of the container neck. An overcap or cover which includes a cylindrical plug adapted to be positioned within the cylindrical conduit of the washer-like element is provided and has a plurality of apertures in surrounding relation to the plug. This structure, while suitable for dispensing liquids, fine-particle slurries, powders and other flowable materials, is incapable of providing a vacuum-tight seal without a heat-sealed foil liner as described above and, as such, is not suitable for hot fill packaging.

Similarly, U.S. Pat. No. 3,209,388 which issued on Oct. 5, 1965, shows a dispensing closure intended for use with containers that are adapted to discharge their contents in response to pressure applied to the container walls, such as, for example, squeeze tubes. As shown therein, the closure includes a screw cap which is threadedly received on external screw threads of the neck of a squeeze tube. A gasket is interposed between the inner surface of the screw cap and the inner face of the squeeze tube. Both the screw cap and the gasket, however, have a central opening in which a pin on a closing cap is received. As such, this structure does not enable the formation of a vacuum-type seal between the opening of the screw cap and the pin of the closing cap. Moreover, the pin on the closing cap of the structure shown in this prior art patent does not permit the use of a heat sealed foil covering on the mouth of the neck of the squeeze tube. Accordingly, this prior art closure is likewise incapable of providing satisfactory performance as a dispensing closure for hot fill packaging.

Correspondingly, U.S. Pat. No. 5,110,017 which issued on May 5, 1992 describes a closure cap that is threadedly mounted for restricted rotation on the neck of a dispensing container so that, upon elevation of the cap, a product release passage is established from the mouth of the container through product discharge ports formed in the top end wall of the cap. The structure shown in this patent is likewise not suited for hot fill packaging since it likewise does not, in the absence of a heat sealed foil on the open mouth of the container neck, provide a vacuum-tight seal.

The present invention overcomes the problems and disadvantages of these prior art closures and provides a new and improved dispensing closure having significant advantages thereover.

SUMMARY OF THE INVENTION

In accordance with the present invention, a novel dispensing closure is provided which achieves a vacuum seal without requiring the use (and accompanying inconvenience) of a heat sealed foil liner on the mouth of a container to which it is applied. This dispensing closure includes a rotatable outer cap that overlies, and is relatively moveable with respect to, an inner cap secured to the container mouth. The inner and/or outer caps can be integrally formed with a resilient thermoplastic gasket liner system that provides vacuum seals both between the inner or outer caps and container as well as between the inner cap and outer cap. In the illustrated embodiments, rotation of the outer cap causes it to axially move from a closed position wherein both seals are active to a dispensing position wherein at least the seal between the inner and outer caps is deactivated. Preferred resilient thermoplastic materials include the vinyl chloride-free thermoplastic elastomers which, in accordance with an important aspect of this invention, are formed by molding and to which the inner and/or outer caps are then molded in a two-material molding operation. If desired, this dispensing closure can be equipped with a tamper indicating band, preferably located at the base of the outer cap, which will separate from the outer cap when it is rotated and axially upwardly moved from the closed to the dispensing position.

It is, therefore, an object of the present invention to provide an improved dispensing closure which is especially adapted for hot fill packaging or the packaging of carbonated beverages.

Another object of the present invention is to provide an improved dispensing closure capable of achieving a vacuum seal without requiring the use of a heat sealed foil liner on the mouth of the container to which it is applied.

Another object of the present invention is to provide an improved dispensing closure for hot fill packaging which closure incorporates a thermoplastic elastomer liner system that enables the formation and maintenance of a vacuum seal between an inner and/or outer cap components of the closure and a container to which it is applied as well as between the inner and/or cap components of the closure.

Another object of the present invention is to provide an improved dispensing closure having a novel seal forming component which utilizes a thermoplastic elastomer liner integrally formed with the inner and/or outer cap components of the closure which are manufactured by a two-material molding process.

These and other objects of the present invention will be apparent from the following detailed description taken in conjunction with the accompanying drawings wherein like reference numerals refer to like parts in which:

FIG. 15 is a schematic perspective view of another form of molded resilient liner of the inner cap of the dispensing closure shown in FIGS. 1–7 which resilient liner has four flow bridges interconnecting the upper and lower seal-forming elements thereof;

FIG. 16 is a schematic perspective view of a further form of molded resilient liner of the inner cap of the dispensing closure shown in FIGS. 1–7 which resilient liner has three flow bridges interconnecting the upper and lower seal-forming elements thereof;

FIG. 17 is a schematic perspective view of still another form of molded resilient liner of the inner cap of the dispensing closure shown in FIGS. 1–7 which resilient liner has a single flow bridge interconnecting the upper and lower seal-forming elements thereof;

FIG. 19 is a side elevational view, partially in section, showing the outer cap of the dispensing closure illustrated in FIG. 18;

FIG. 20 is a top plan view of the outer cap of the dispensing closure shown in FIG. 18;

FIG. 21 is a bottom plan view of the outer cap of the dispensing closure shown in FIG. 18;

Figure 1:
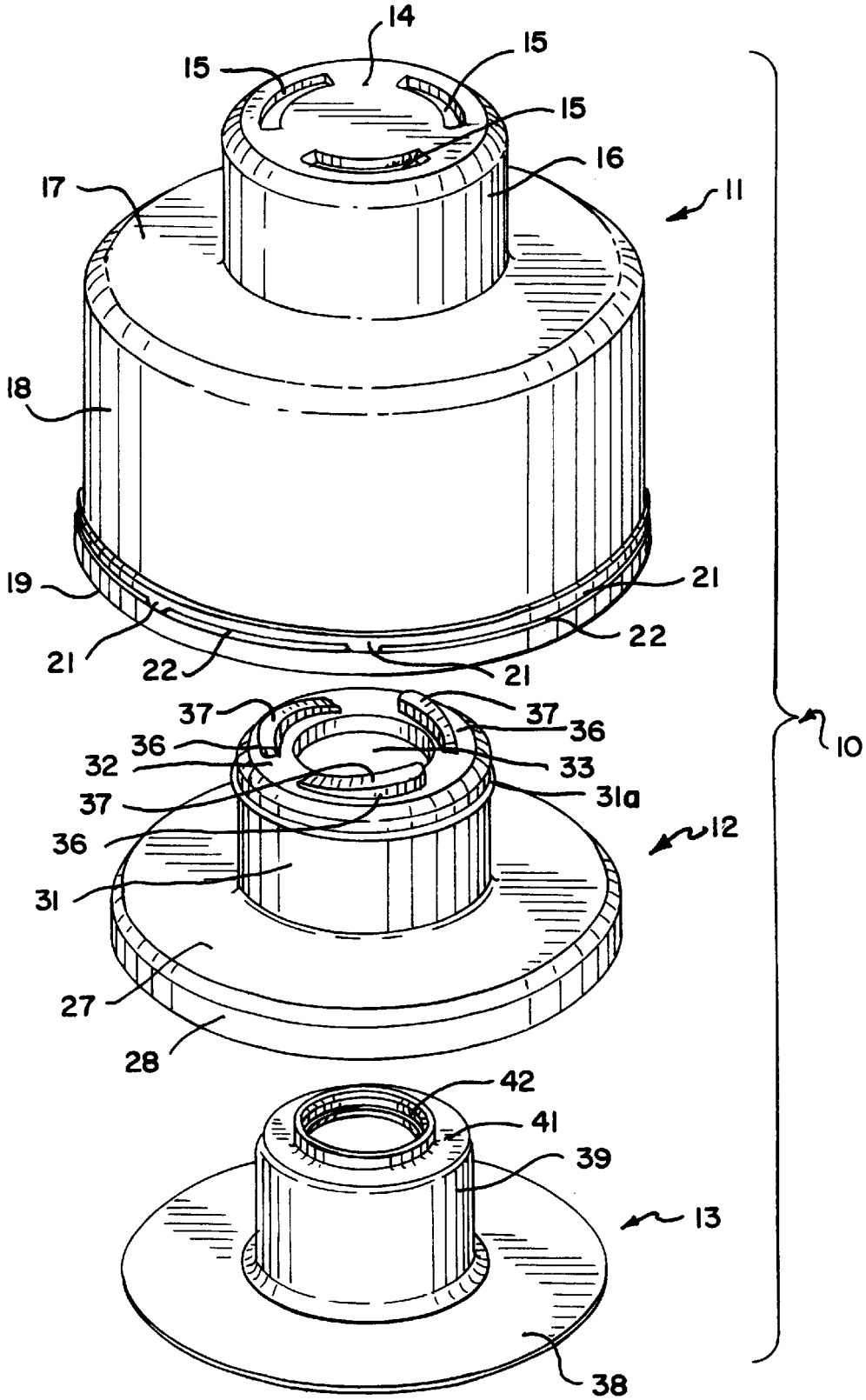
FIG. 1 is an exploded perspective view of a dispensing closure in accordance with one embodiment of the present invention separately illustrating the outer cap, the inner cap, and the resilient liner component of the inner cap.
Figure 2:
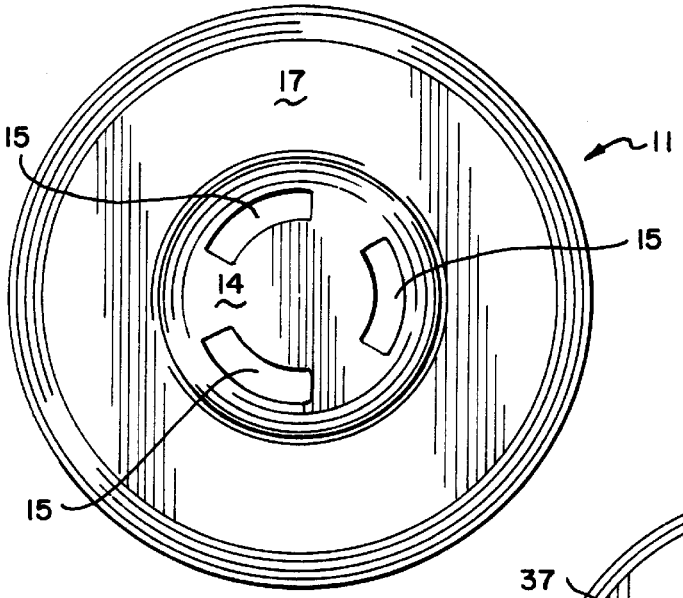
FIG. 2 is a top plan view of the outer cap of the dispensing closure shown in FIG. 1.
Figure 4:
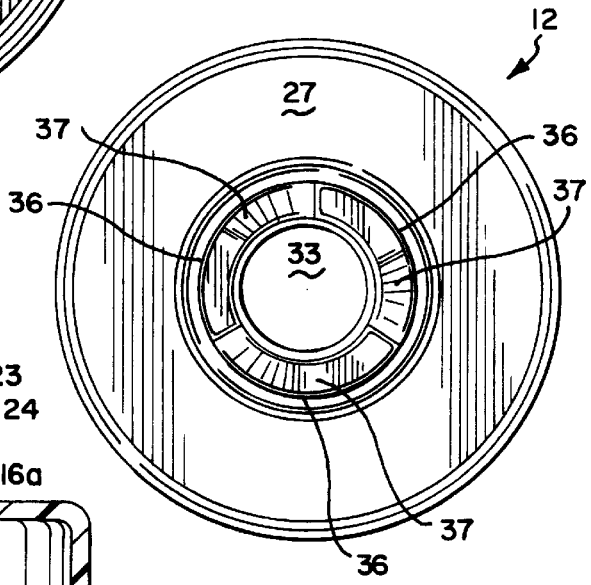
FIG. 4 is a top plan view of the inner cap of the dispensing closure shown in FIG. 1.

Referring to the drawings, and with particular reference to FIGS. 1–7, a dispensing closure embodying the present invention is generally designated by the reference numeral 10. As shown, the dispensing closure 10 includes an outer cap 11, an inner cap 12 and a resilient liner 13. As will be described more fully below, the inner cap 12 and resilient liner 13 are integrally formed in two-material molding process, an illustrative version of which is depicted in FIGS. 8–11.

Figure 3:
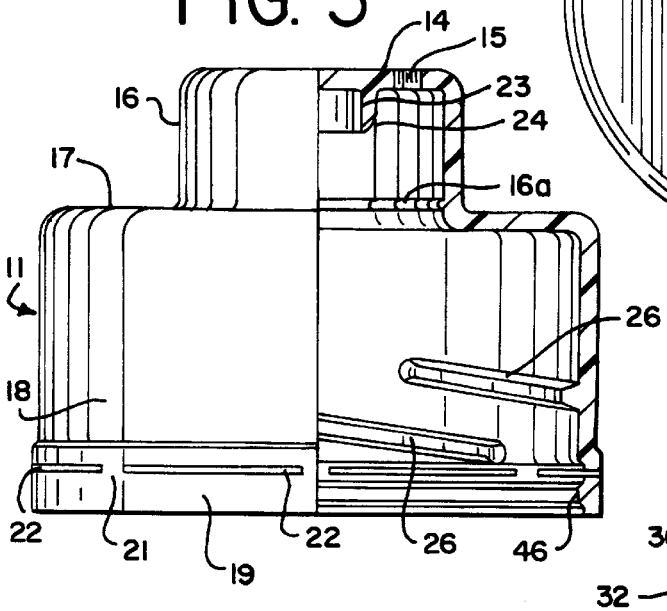
FIG. 3 is a side elevation view, partially in section, showing the outer cap of the dispensing closure illustrated in FIG. 1.

Outer cap 11 is preferably formed of a thermoplastic or thermoset resin, however, homopolymers, copolymers and terpolymers of ethylene and/or propylene are generally preferred with propylene being especially preferred. A plurality of dispensing apertures 15 are located in end panel 14 which extends axially downwardly into a cylindrical sidewall 16 that, in turn, extends into a radially outwardly extending annular shoulder 17. A skirt 18 depends from the outer peripheral edge of annular shoulder 17 and a tamper indicating band 19 is connected to the lowermost portion of skirt 18 by a plurality of molded bridges 21 separated by gaps 22 which provide a line of weakness enabling the tamper indicating band to be severed from the skirt when the outer cap is moved axially upwardly from its fully applied position on a bottle, jar or like container. If desired, this line of weakness can be formed by slitting. As best shown in FIG. 3, outer cap end panel 14 has on the interior surface thereof, a plug 23 which is defined by a downwardly extending circular wall 24. In the illustrated embodiment, a plurality of threads 26 are shown, however, it will be appreciated that the multi-lead thread configuration of this illustrated embodiment, if desired, could be replaced by a single continuous thread or lug arrangement which is adapted to matingly engage and cooperate with the thread configuration on the neck of a bottle or jar to which the dispensing closure is applied.

Figure 5:
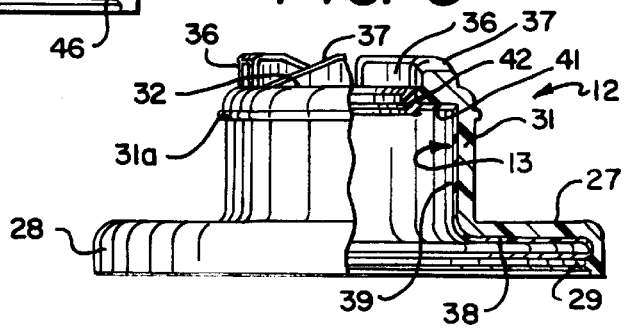
FIG. 5 is a side elevational view, partially in section, of the inner cap of the dispensing closure shown in FIG. 1.

Inner cap 12 includes an outer annular flange 27 which extends radially outwardly terminating in a lip portion 28 having an inwardly extending bead 29 adapted to provide a secure snap fit on a corresponding groove in a container to which it is applied. The interior periphery of outer annular flange 27 extends upwardly into a tubular sidewall 31 which, in turn, extends into an inwardly extending circular flange 32 that defines a cylindrical opening 33. As best shown in FIGS. 1 and 5, an upper surface of inwardly extending flange 32 is provided with a plurality of upwardly extending projections 36 having cammed surfaces 37 sized to be received within the apertures 15 in the end panel of outer cap 11. The cammed surfaces 37 of projections 36 cooperate with the inside surfaces adjacent apertures 15 in the end panel of outer cap 11 to facilitate the travel of projections 36 into and out of those apertures when the outer cap is respectively moved into closed and dispensing positions as will be described more fully hereinafter.

In the embodiment illustrated in FIGS. 1–7, resilient liner 13 includes an outer annular flange 38 that extends at its inner periphery into an upwardly projecting tubular section 39 which, in turn, extends into a radially inwardly projecting annular flange section 41, terminating in an inwardly projecting lip 42 adapted to provide a vacuum seal with the outer surface of downwardly extending cylindrical wall 24 of the outer cap 11.

Resilient liner 13 can be formed of any suitable resilient or elastomeric materials which provide the desired seal with the finish of a container and with the downwardly extending circular wall 24 of plug 23. In this regard, however, moldable vinyl chloride-free resins or non-PVC resins are preferred. These non-PVC materials include rubbery block copolymers dispersed in a matrix of polyolefin as a continuous phase with moldable thermoplastic elastomers being especially preferred since they possess a number of processing advantages and can be used with little or no extra compounding, vulcanization or heating steps. For example, gasket compositions composed of a thermoplastic elastomeric material selected from a moldable, saturated ABA type block copolymers based on styrene and butadiene such as styrene-ethylene-butylene-styrene (SEBS) type block copolymers containing from about 20% to about 40% styrene and 60% to 80% ethylene-butylene co-monomers, such as Kraton® G-2705 available from Shell Chemical Corporation, can be effectively used. Preferred thermoplastic elastomers include the EPDM (ethylene-propylene-dicyclopentadiene) elastomers such as those commercially available under the trade designation Santoprene® 21–64 from Monsanto Company.

Figure 6:
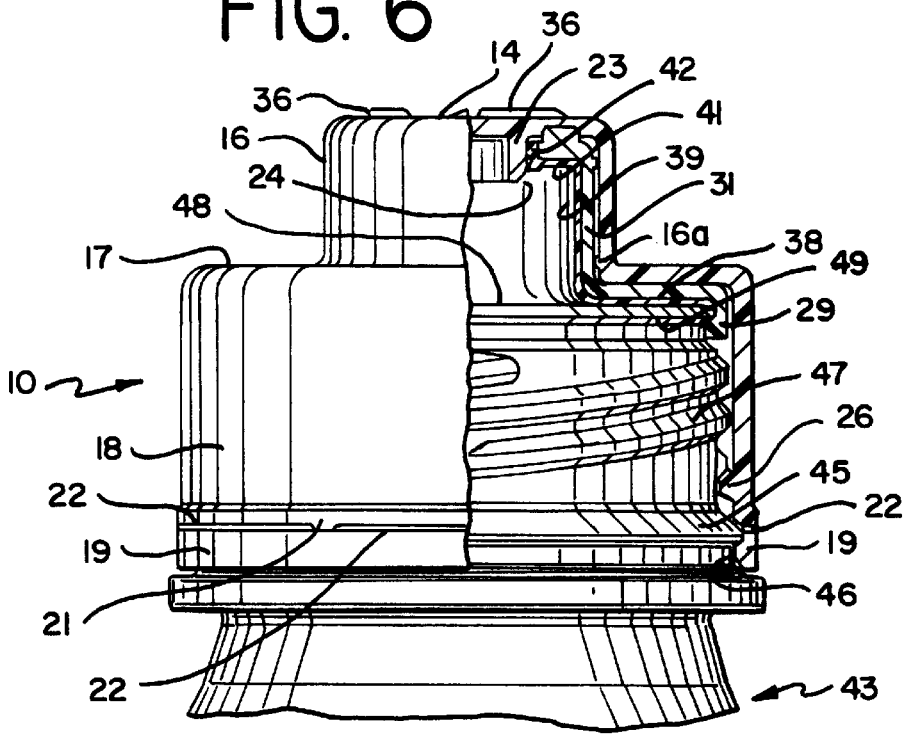
FIG. 6 is a side elevational view, partially in section, of the dispensing closure shown in FIG. 1 applied to a bottle and in closed position.
Figure 7:
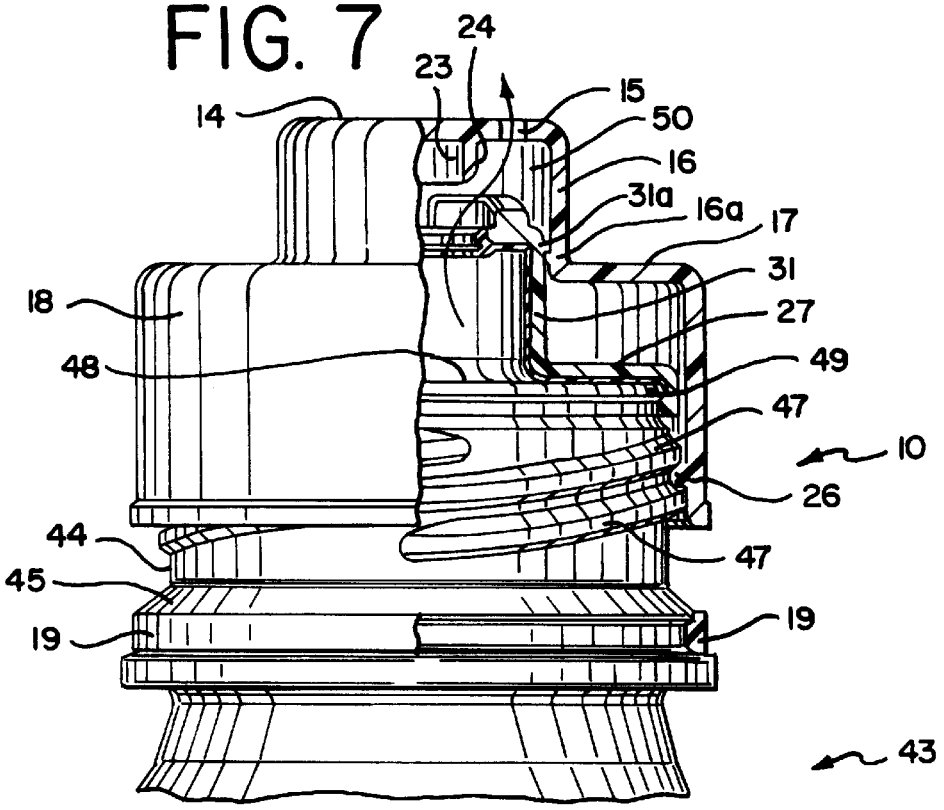
FIG. 7 is a side elevation view, partially in section, of the dispensing closure/bottle combination shown in FIG. 6 with the outer cap of dispensing closure in a dispensing position.

As shown in FIGS. 6 and 7, the dispensing closure 10 is adapted to be directly applied to a container such as, for example, a bottle or a jar which includes a neck 44. Preferably, such container will have an outwardly extending retainer bead 45 at the base of the neck which includes a downwardly inclined surface enabling the inwardly projecting bead 46 on tamper band 19 of the outer cap to be passed thereover and captured within a groove therebelow. A plurality of threads 47 on the outer surface of container neck 44 cooperate with the threads 26 on the interior of the skirt 18 of outer cap 11 enabling the outer cap to be axially moved upwardly and downwardly by rotation.

As shown, container neck 44 terminates in a neck finish 48 that defines an open mouth providing access to the interior of the container. The neck finish 48 is provided with an outwardly extending lip 49 over which the bead 29 of inner cap 12 can be snapped fitted and securely retained thereon.

In the closed position depicted in FIG. 6, the bottom surface of outer annular flange 38 of resilient liner 13 contacts the neck finish 48 of container 43 to provide a vacuum seal therewith. Correspondingly, the inwardly projecting lip 42 of resilient liner 13 provides a vacuum seal with the outer surface of downwardly extending circular wall 24 on outer cap 11. Counter-clockwise rotation of outer cap 11 causes the outer cap to be moved axially upwardly causing fracturing of the bridges 21 at the base of the skirt thereof and resulting in the tamper band 19 being separated therefrom. Continued rotation of the closure cap results in axial displacement of the plug 23 from the lip 42 on resilient liner 13, thereby creating a passageway for the dispensing of the contents of the container through cylindrical opening 33 into the annular space 50 between the outer surface of cylindrical wall 24 and the inner surface of cylindrical sidewall 16 and apertures 15. As will be appreciated, the seal between container neck finish 48 and the outer annular flange 38 of resilient liner 13 remains intact. If desired, a liquid tight seal between the outer and inner caps can be provided by molding a seal bead 31*a* on the upper portion of the outside surface of the tubular sidewall 31 of inner cap 12 and a seal bead 16*a* on the lower portion of the inside surface of cylindrical sidewall 16 of outer cap 11. Such a seal prevents product from leaking between these two caps during a dispensing operation.

A suitable procedure for the manufacture of the integral inner cap/resilient liner component of this dispensing closure is illustrated by the sequential steps shown in FIGS. 8–11. In particular, these figures generally depict a two material molding process wherein the liner is initially formed by molding the same in a first station followed by molding of the plastic inner cap to the previously molded liner in a second station. If desired, however, the inner cap can be initially molded in a first station followed by molding of the resilient liner thereto in a second station. Correspondingly, in some instances, separate molding of each of these components followed by mechanical insertion of the preformed liner or liner components into the interior of the inner cap (with or without an adhesive or bonding agent) could be employed.

Figure 8:
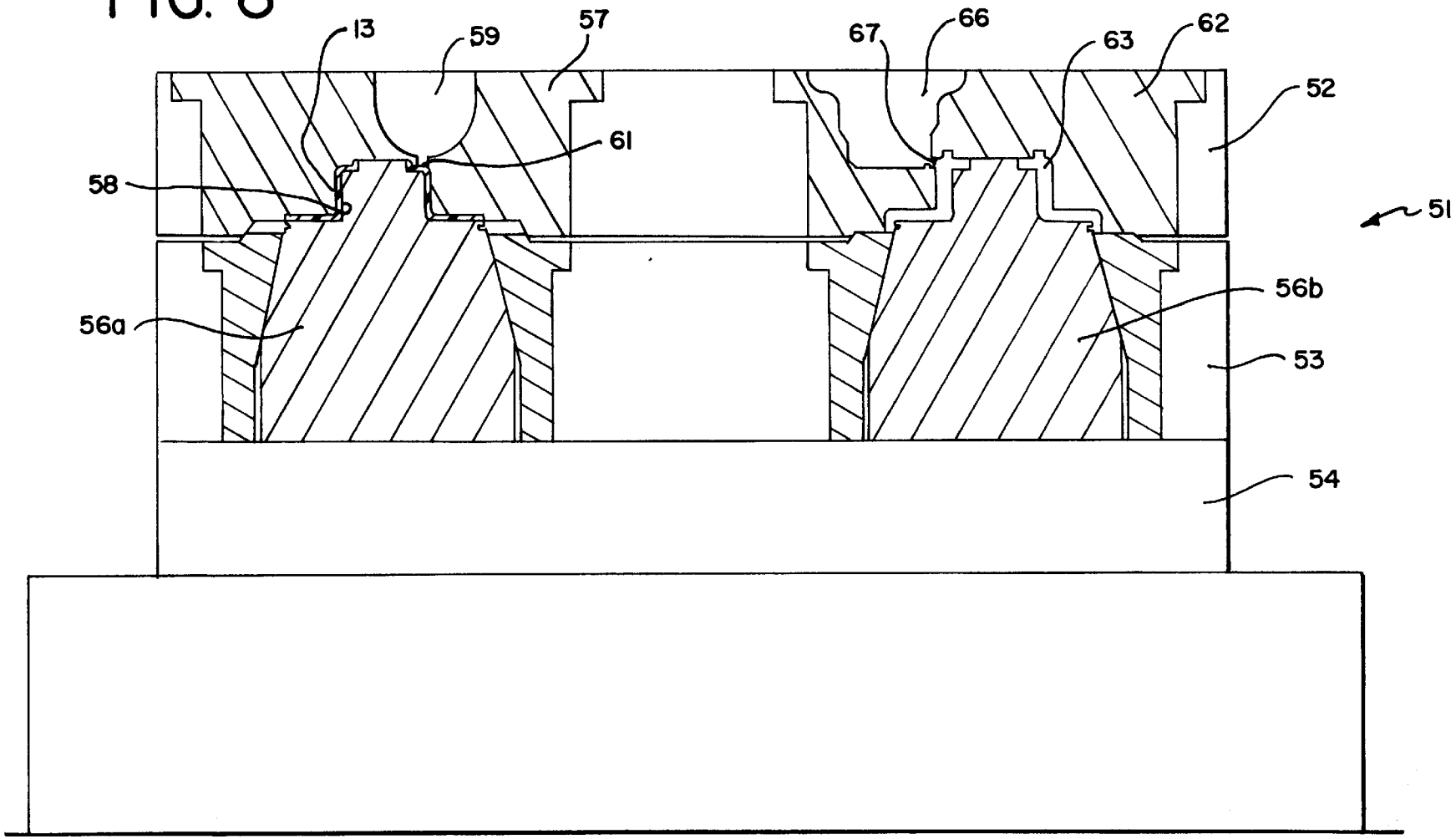
FIG. 8 is a schematic view of a dual station mold with the upper and lower components thereof in a closed position illustrating the formation of a thermoplastic liner in accordance with one aspect of the present invention.
Figure 9:
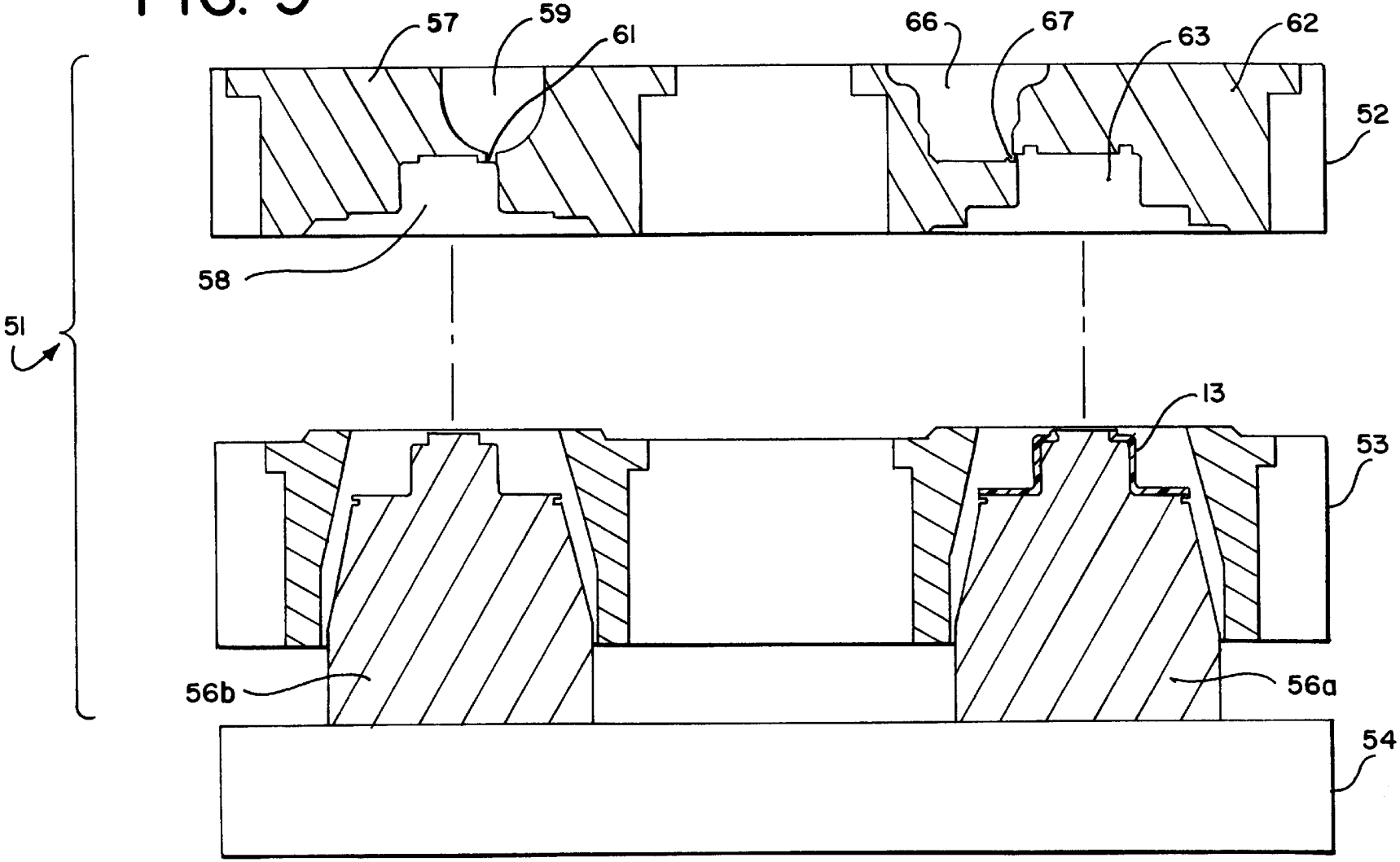
FIG. 9 is a schematic view of the dual station mold shown in FIG. 8 with the upper and lower components thereof in an opened position illustrating the thermoplastic liner in the inner cap forming station.

Referring to FIGS. 8–11, the reference numeral 51 generally designates an injection molding apparatus which includes an upper mold component 52 and a lower mold component 53 which is mounted on a turn table 54. Lower mold component 53 is provided with a pair of identical cores 56*a* and 56*b*. As shown in FIG. 8, core 56*a* cooperates with upper mold element 57 to provide a first cavity 58 having the configuration of the resilient liner. A melt supply chamber 59 feeds resilient liner melt through gate 61 into cavity 58 to mold the resilient liner 13.

Figure 10:
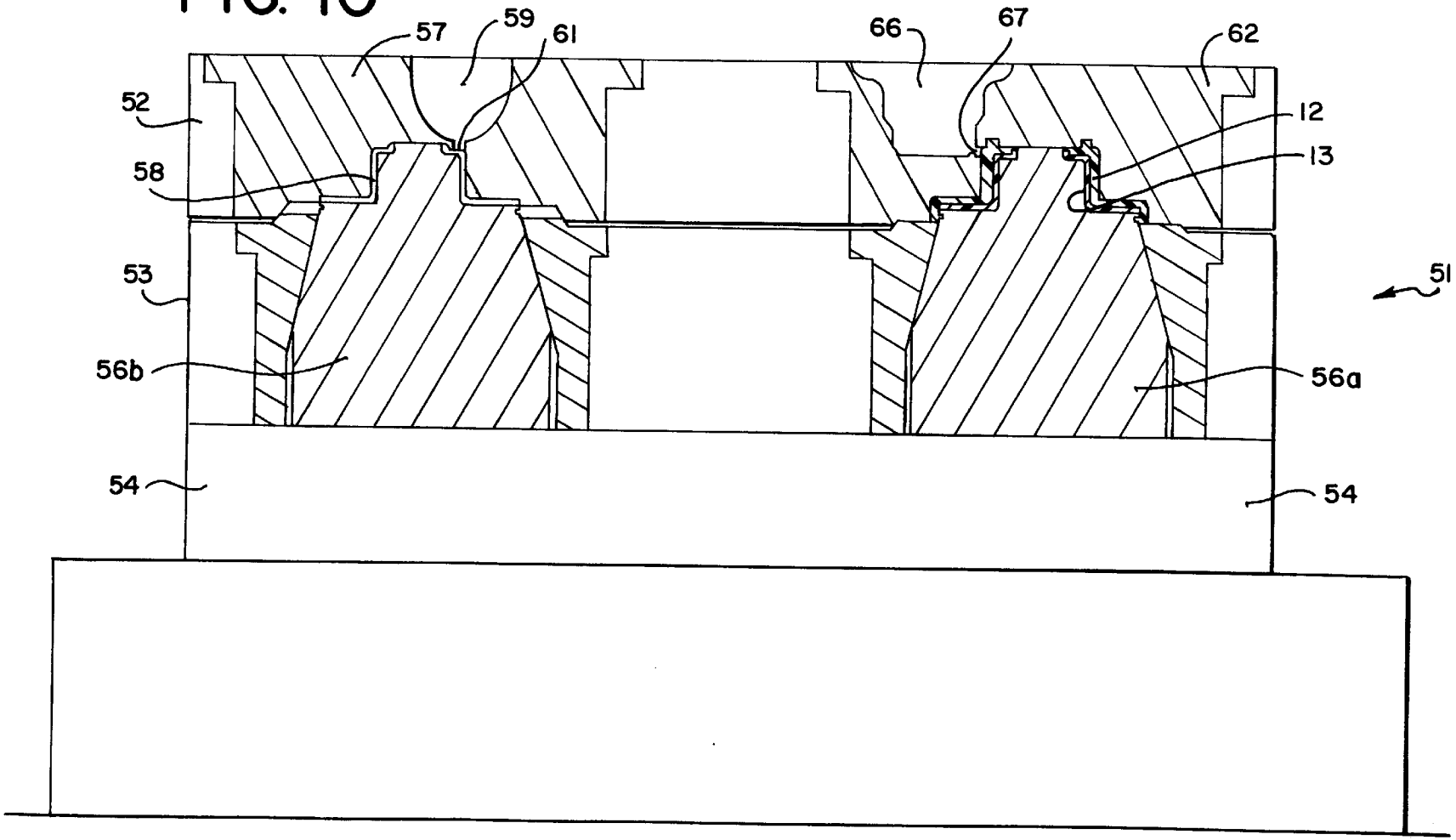
FIG. 10 is a schematic view of the dual station mold shown in FIGS. 8 and 9 with the upper and lower components thereof in a closed position illustrating the formation of the inner cap on a previously formed resilient liner.
Figure 11:
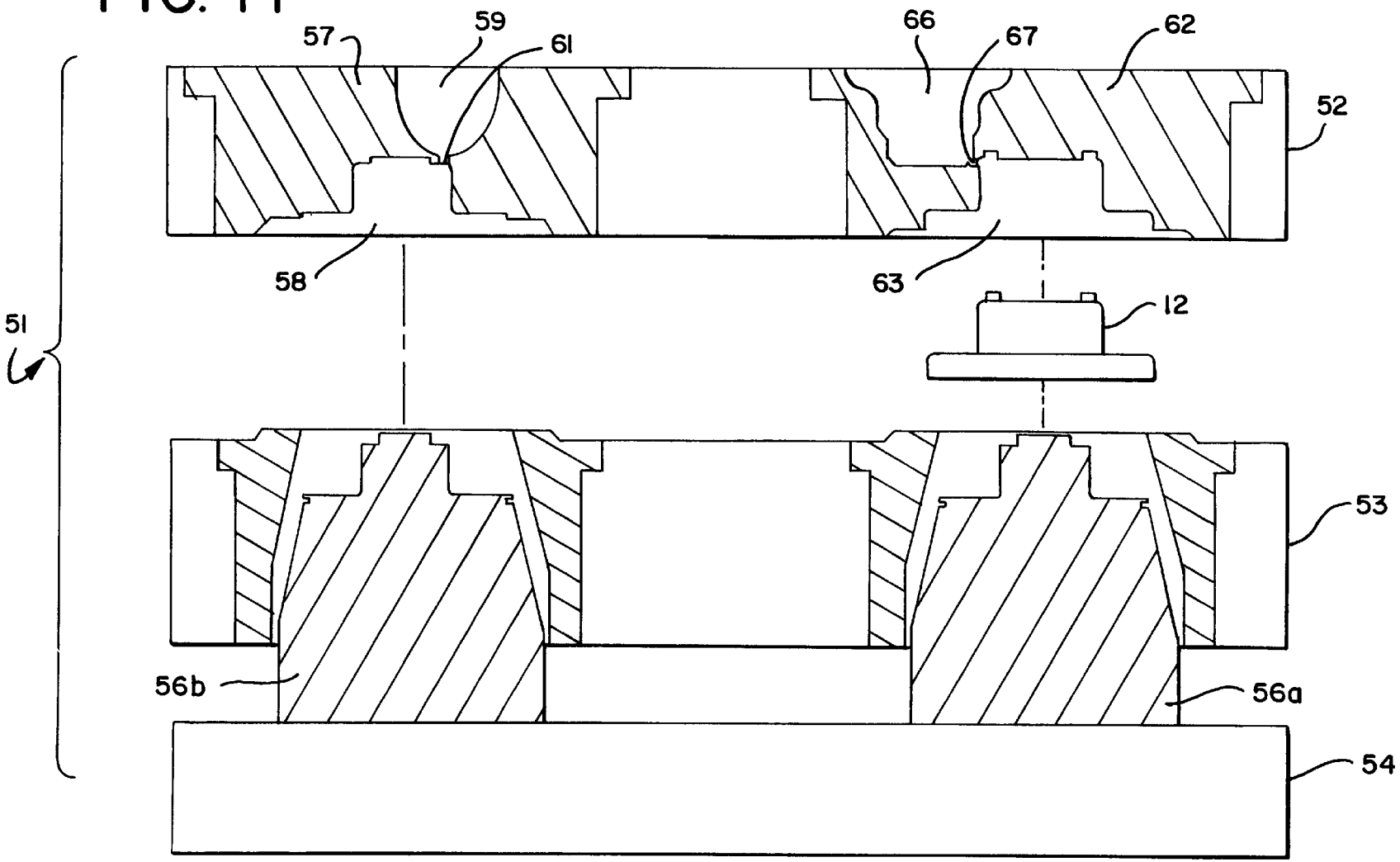
FIG. 11 is schematic view of the dual station mold shown in FIGS. 8–10 with the mold components separated illustrating the finished inner cap with the molded liner being ejected.

Following formation of the resilient liner 13, the upper mold component 52 is raised and the thus formed resilient liner 13 on core 56*a* is rotated so that core 56*a* is now in alignment with an upper mold element 62. The mold is then closed as shown in FIG. 10 with upper mold element 62 now cooperating with the previously molded resilient liner 13 on core 56*a* and upper mold element 62 to define a cavity 63 which is configured in accordance with the shape of the inner cap 12. A suitable inner cap-forming-melt is injected into the cavity 63 from a melt supply chamber 66 via gate 67. Upon completion of the formation of the inner cap, the mold is then opened as shown in FIG. 11 and the finished part ejected via a suitable knock-out piston or cylinder (not shown).

Figure 12:
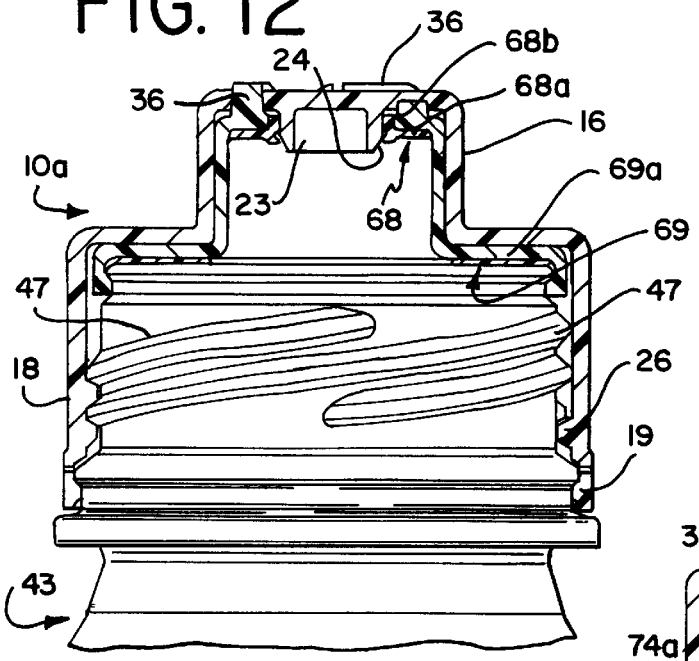
FIG. 12 is a side elevational view, partially in section, of another embodiment of the dispensing closure of the present invention applied to a bottle.
Figure 13:
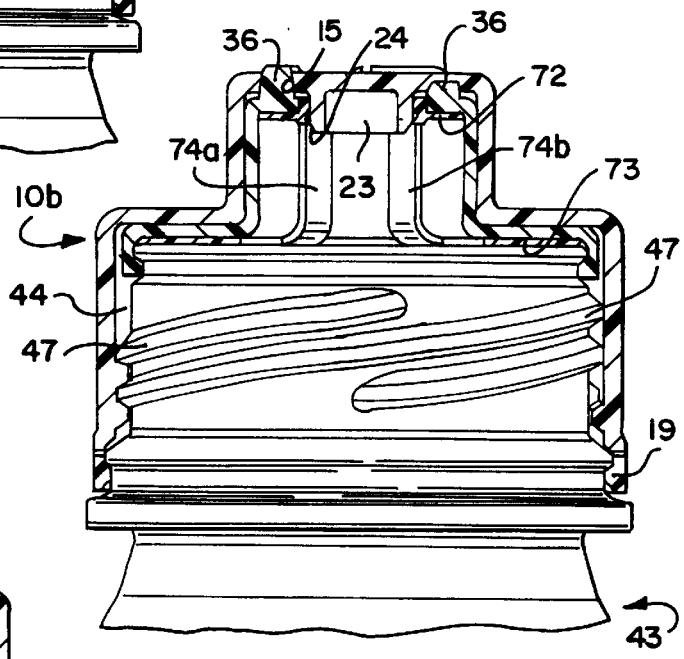
FIG. 13 is a side elevational view, partially in section, of a still further embodiment of the dispensing closure of the present invention applied to a bottle.

FIGS. 12 and 13 respectively illustrate alternate embodiments of the present invention identified by the reference numerals 10*a* and 10*b*. These dispensing closures are similar to the embodiment described in conjunction with FIGS. 1–7 except for the structure of the molded resilient liner. Accordingly, like reference numerals have been used to designate like parts therein and the foregoing description of such like parts applies equally well to these embodiments. As shown in FIG. 12, the resilient liner system in this embodiment is provided by two separate and unconnected liner elements 68 and 69. Upper liner element 68 includes an integral annular ring 68*a* and seal forming lip 68*b* which, when the dispensing closure is in a closed position, engages the sidewall 24 of plug 23 to provide a vacuum seal therewith. Correspondingly, the bottom liner element 69 consists of an annular ring 69*a* similar to ring portion 38 of the resilient liner 13 and provides a vacuum seal with the neck finish 48 of container 43. As will be appreciated, the top and bottom liner elements 68 and 69 can be simultaneously formed in a mold having two separate liner forming cavities each of which is associated with its own gate.

The embodiment of FIG. 13 includes a top liner 72 and bottom liner 73 which are interconnected by a plurality of melt flow bridges 74*a* and 74*b*, enabling both of liner elements 72 and 73 to be simultaneously formed by molding from a single gate melt supply source.

Figure 14:
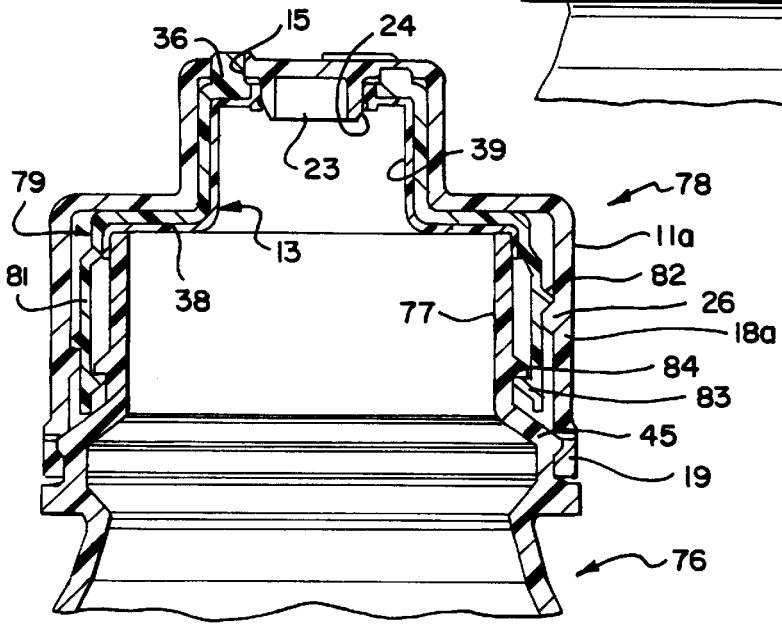
FIG. 14 is a side elevational view, in section, showing a yet further embodiment of the dispensing closure of the present invention applied to a bottle.

A yet further embodiment of the present invention is shown in FIG. 14 which is particularly suited for hot fill packaging of containers or bottles 76 having a neck portion 77 which does not includes any threads. This embodiment is generally designated by the reference numeral 78 and includes an outer cap designated by the reference numeral 11*a* which is generally similar in construction with that shown in FIGS. 1–7 and designated by the reference numeral 11 therein. The only difference between the two being that in this particular embodiment, the skirt portion 18*a* is somewhat enlarged in order to accommodate an inner cap 79 that includes a skirt 81 having at least one thread 82 on the outer surface thereof. Inner cap 79 is secured to the container neck 77 by an inwardly extending bead 83 on the inside surface of the skirt 81 which is adapted to be snapped over, and retained by, an outwardly extending circumferential bead 84 on the neck 77 of container or bottle 76. In this embodiment, the thread 26 on the inner surface of skirt 18*a* cooperates with the inner cap thread 82 to enable the outer cap 79 to be axially moved from its closed position to an open position similar to that depicted in FIG. 7. In essentially all other respects, the dispensing closure 78 has a similar construction and mode of operation to that shown in FIGS. 1–7.

FIGS. 15–17 schematically illustrate perspective views of alternate forms of the molded liner shown in the closure cap 10*b* of FIG. 13 and designated therein by the reference numerals 72, 73, 74*a* and 74*b*. In particular, FIG. 15 shows a molded resilient liner 86 having a top liner element 72*a* and a bottom liner element 73*a* interconnected by four flow bridges 87*a*, 87*b*, 87*c* and 87*d*. Correspondingly, FIG. 16 is a schematic perspective view of a similar molded resilient liner system 88 having a like top liner element 72*a* and bottom liner element 73*a* interconnected by three flow bridges 89*a*, 89*b* and 89*c*. In like fashion, FIG. 17 shows a resilient liner 91 having a top liner element 72*a* and bottom liner element 73*a* interconnected by a single flow bridge 92. Each of the resilient liners 86, 88 and 91 can be formed by single gate molding procedures or, if desired, by using molding techniques involving two or more gates.

Figure 18:
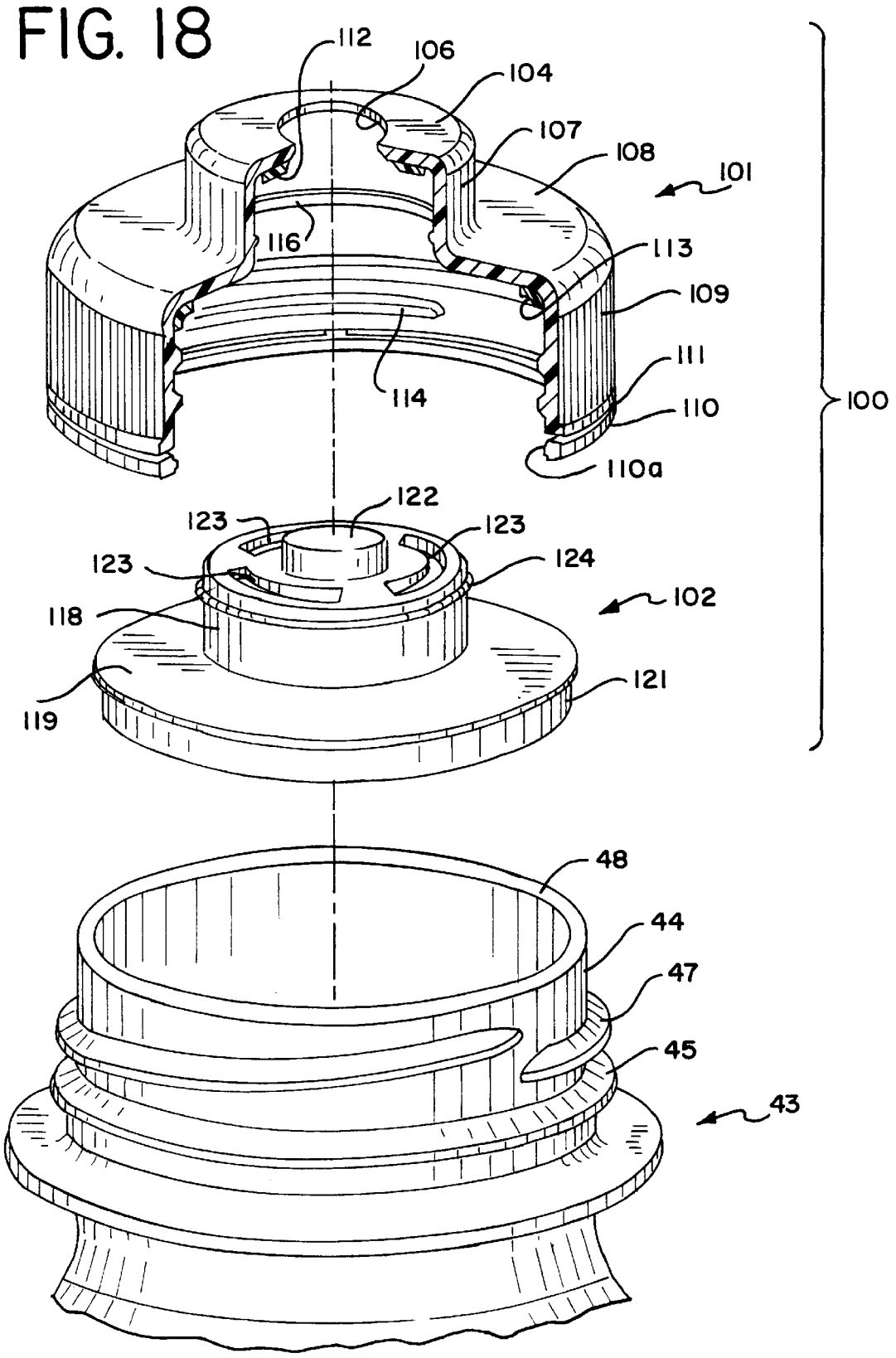
FIG. 18 is an exploded perspective view, partially in section, of a still further embodiment of the dispensing closure of the present invention illustrating an outer cap, inner cap and the neck of a container to which the dispensing closure is to be applied.
Figure 22:
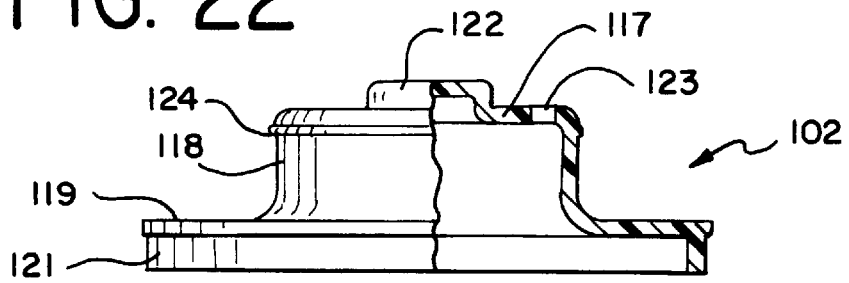
FIG. 22 is a side elevational view, partially in section, showing the inner cap of the dispensing closure illustrated in FIG. 18.
Figure 23:
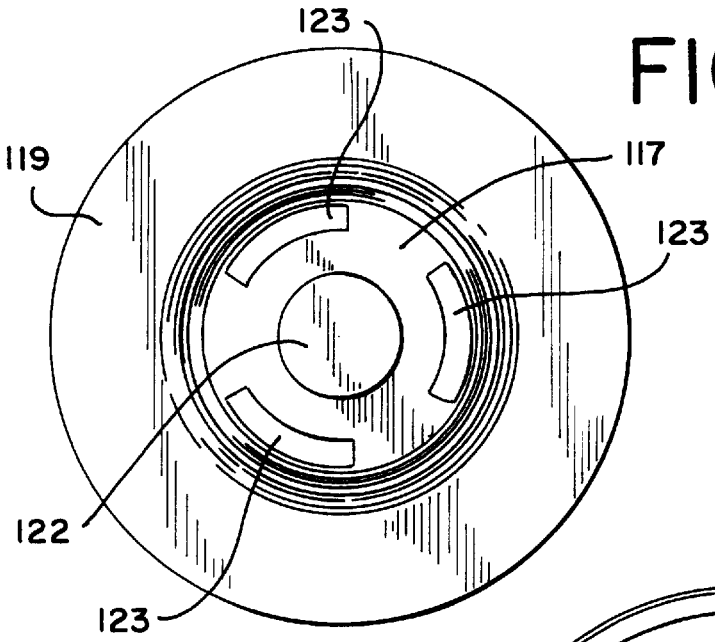
FIG. 23 is a top plan view of the inner cap of the dispensing closure shown in FIG. 18.
Figure 24:
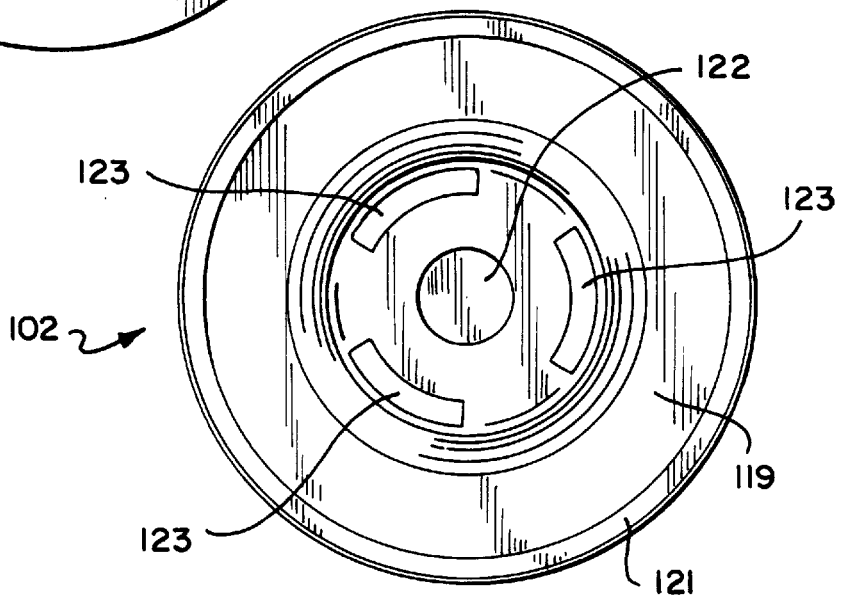
FIG. 24 is a bottom plan view of the inner cap of the dispensing closure shown in FIG. 18.

FIGS. 18–26 illustrate a still further embodiment of the present invention generally designated by the reference numeral 100. This embodiment includes an outer cap 101 (separately shown in FIGS. 19–21) and an inner cap 102 (separately shown in FIGS. 22–24) which, in FIG. 18, are depicted in overlying relation to a partially illustrated container 43 identical to that previously shown in FIGS. 6, 7, 12 and 13.

Outer cap 101 includes an end panel 104 having an inner edge 106 which defines a generally centrally located opening and an outer edge that extends into a downwardly axially projecting sidewall 107 which, in turn, projects radially outwardly to define an annular shoulder 108, the outer edge of which extends axially downwardly to define a skirt 109. As shown, the outer surface of skirt 109 can be knurled to facilitate the hand rotation thereof. A tamper indicating band 110 having an inwardly projecting bead 110*a* is connected to the bottom edge of skirt 109 by a plurality of molded bridges 111 (best shown in FIG. 19) separated by a plurality of gaps 111*a* which provide a line of weakness enabling the tamper indicating band to be severed from the skirt when the outer cap is moved axially upwardly from its fully applied position on a bottle, jar or like container. As previously noted in connection with the other embodiments of this invention, this line of weakness can also be formed by slitting.

As best shown in FIGS. 18, 19 and 21, the interior of outer cap 101 is provided with an upper annular resilient liner 112 formed on the inside surface of end panel 104 and a lower annular resilient liner 113 located at the junction between the interior of annular shoulder 108 and skirt 109. As with the previously described embodiments, resilient liners 112 and 113 can be formed of any suitable elastomeric material such as, for example, the previously identified preferred thermoplastic elastomers.

If desired, an integral seal bead 116 can be provided at the lower interior portion of cylindrical sidewall 107. In the illustrated embodiment, the interior of skirt 109 is provided with a plurality of threads 114. If desired, other thread or lug arrangements may be used.

The inner cap 102 of dispensing closure 100 is best depicted in FIGS. 18 and 22–24. As shown, inner cap 102 includes an end panel 117 that extends axially downwardly into a tubular sidewall 118 which, in turn, extends radially outwardly into an outer annular flange 119 from which a bottom rim 121 of reduced diameter extends. Rim 121 is sized to be snugly received within the open mouth defined by finish 48 of container 43. If desired, however, inner cap 102 can be constructed with a lip portion and inwardly extending bead similar to the lip portion 28 and inwardly extending bead 29 best shown in FIG. 5 to provide a snap fit connection to a container.

In accordance with the present invention, end panel 117 of inner cap 102 includes a generally centrally located and upwardly projecting closed plug 122 which is to be received within the aperture defined by inner edge 106 of outer cap 101 when the inner and outer caps are in a closed position. A plurality of apertures 123 surround plug 122 to provide a passage through which the contents of a container can be dispensed.

Figure 25:
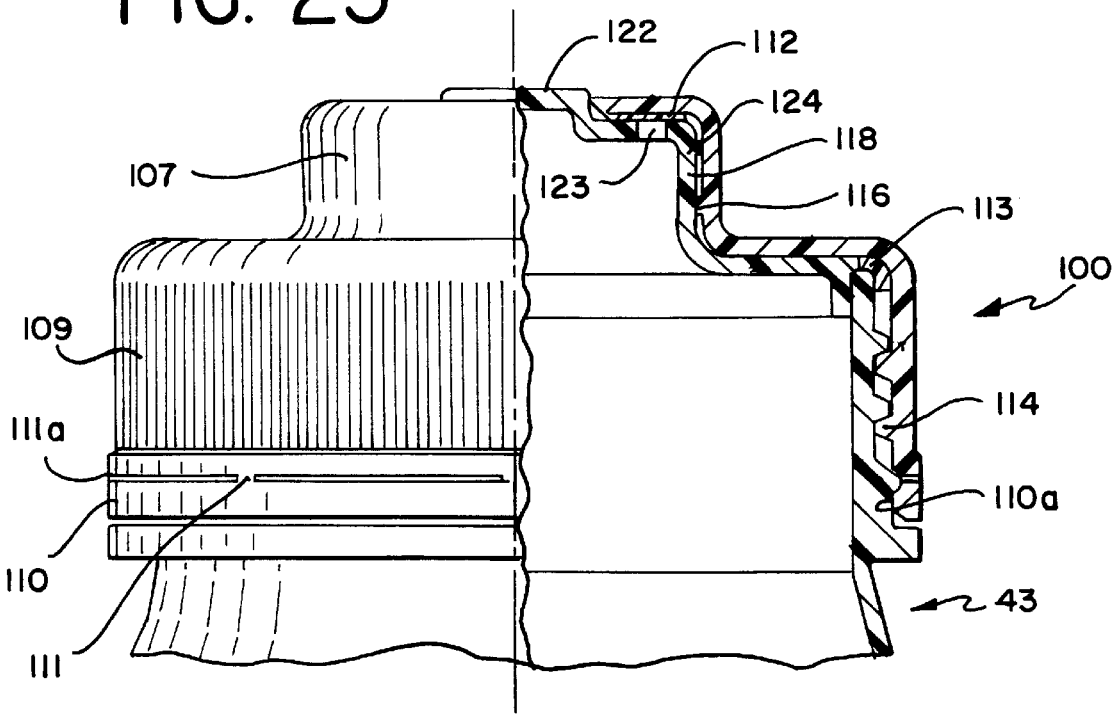
FIG. 25 is a side elevational view, partially in section, of the dispensing closure shown in FIG. 18 applied to a bottle and in a closed position; and, FIG. 26 is a side elevational view, partially in section, of the dispensing closure/bottle combination shown in FIG. 25 with the outer cap of the dispensing closure in a dispensing position.
Figure 26:
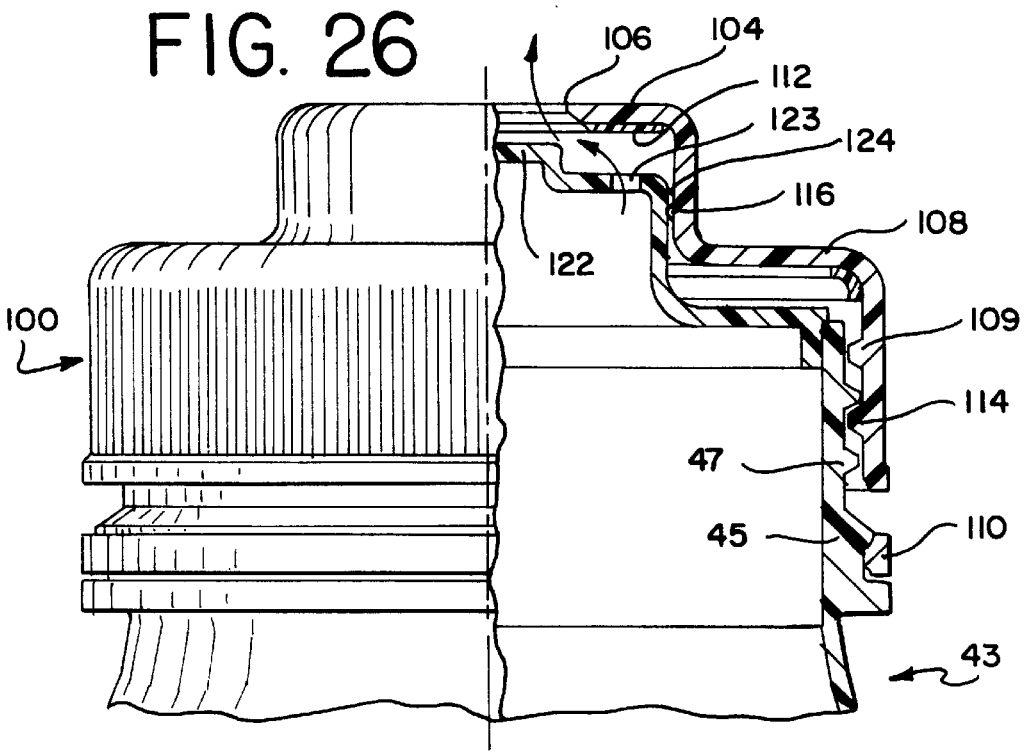

As shown in FIGS. 25 and 26, the dispensing closure 100 is adapted to be directed applied to a container such as, for example, a bottle or a jar. Preferably, the container will have an outwardly extending retainer bead 45 at the base of the neck which includes a downwardly inclined upper surface enabling the inwardly projecting bead 110*a* of the outer cap to be passed thereover and captured within a groove therebelow. A plurality of threads 47 on the outer surface of container neck 44 cooperate with the threads 114 on the interior of the skirt 109 of outer cap 101 enabling the outer cap to be axially moved upwardly and downwardly by rotation.

In the closed position depicted in FIG. 25, the bottom surface of resilient liner 113 contacts the neck finish 48 of container 43 to provide a vacuum seal therewith. Correspondingly, the bottom surface of upper and annular resilient liner 112 provides a vacuum seal with the end panel 117 of inner cap 102. Counter-clockwise rotation of outer cap 101 causes the outer cap to be moved axially upwardly resulting in the fracturing of the bridges 111 at the base of the skirt 109 of the outer cap resulting in the tamper band 110 being separated therefrom. Preferably, the dimensions of the relative elements of the dispensing closure 100 are such that the vacuum seal maintained between annular resilient liner 112 and end panel 117 will be maintained until such time as the tamper band 110 is separated from the skirt 109. Continued rotation of the outer cap 101 results in axial displacement of the plug 122 from the central opening defined by inner edge 106 of outer cap 101, thereby creating a passageway for dispensing of the contents of the container through the apertures 123 into the annular space adjacent the plug 122 and outwardly from the dispensing closure via the opening defined by inner edge 106 of end panel 104 as schematically shown in FIG. 26. If desired, inner bead 116 on the interior of outer cap 101 and outwardly projecting bead 124 on the exterior of tubular sidewall 118 cooperate to provide a liquid tight seal when the outer and inner caps are in a dispensing position.

The present invention has been described in the context of a number of embodiments. It will be apparent to those skilled in this art, however, that modifications and variations can be made therefrom without departing from the spirit and scope of this invention. Accordingly, this invention is to be construed and limited only by the scope of the appended claims.

We claim:

1. A dispensing closure for a container having a cylindrical neck which terminates in an end finish that defines an open mouth, said closure comprising:

an outer cap and an inner cap, said outer cap being movable with respect to said inner cap between a closed position and a dispensing position;

said outer cap including an end panel and a generally cylindrical sidewall extending downwardly therefrom, at least one aperture in said end panel forming a passage through which the contents of said container can be dispensed, an annular shoulder integral with and radially outwardly extending from a lower portion of said cylindrical sidewall, the outer portion of said shoulder extending into an axially downwardly projecting cylindrical skirt, said skirt being dimensioned to be received in surrounding relation to the neck of said container, an inner surface of said cylindrical skirt including at least one thread;

said inner cap being adapted to be secured to said container neck and including an outer annular flange adapted to overlie the open mouth of said container, the inner portion of said annular flange extending into an axially projecting tubular sidewall which terminates in an end panel having at least one aperture formed therein through which the contents of said container can be dispensed, said at least one aperture in said inner cap and said at least one aperture in said outer cap being in fluid flow communication when said outer and inner caps are in said dispensing position; and, a resilient liner on at least one of said inner cap and said outer cap for providing a fluid tight seal between the respective apertures formed therein when said outer and inner caps are in a closed position.

2. The dispensing closure of claim 1 wherein the cylindrical neck of said container includes at least one thread, said at least one thread on the cylindrical skirt of said outer cap being dimensioned to cooperate with said at least one thread on the container neck, whereby when said outer cap is rotated in one direction, the outer cap is axially moved into said closed position and when said outer cap is rotated in an opposite direction, the outer cap is axially moved into said dispensing position.

3. The dispensing closure of claim 1 wherein said inner cap includes an integral downwardly extending cylindrical skirt dimensioned to be received in surrounding relation to the container neck interiorly of the skirt on said outer cap, the outer surface of said inner cap skirt including at least one thread which cooperates with said at least one thread on the inner surface of said outer cap skirt, whereby when said outer cap is rotated in one direction it is axially moved into said closed position and when said outer cap is rotated in an opposite direction it is axially moved into said dispensing position.

4. The dispensing closure of claim 1 wherein said container neck includes a cylindrical bead and said outer Cap skirt includes a tamper indicating band at the lowermost portion of said skirt, said tamper indicating band being joined to said outer cap skirt by a fracturable line of weakness and including an inwardly projecting portion which is adapted to be received below the cylindrical bead of the container when the closure is applied to said container, whereby axial movement of the outer cap will cause the tamper indicating band to be severed from said outer cap skirt when said outer cap is axially moved from the closed to the dispensing position.

5. The dispensing closure of claim 4 wherein said fracturable line of weakness is a plurality of circumferentially disposed fracturable bridges.

6. The dispensing closure of claim 4 wherein said fracturable line of weakness is defined by a circumferential groove.

7. The dispensing closure of claim 6 wherein said groove is formed by slitting.

8. The dispensing closure of claim 1 wherein said resilient liner is composed of a thermoplastic elastomer.

9. The dispensing closure of claim 1 wherein said tubular sidewall on said inner cap terminates in an inwardly extending inner circumferential flange that defines said at least one aperture formed in said inner cap and wherein said resilient liner is on said inner circumferential flange of said inner cap and said outer cap includes a downwardly extending cylindrical plug formed on a closed inside surface of the end panel of said outer cap, whereby said resilient liner is adapted to provide a fluid tight seal with said plug when said outer cap is in a closed position with respect to the inner cap.

10. The dispensing closure of claim 9 wherein said inner cap is composed of a polyolefin and said resilient liner is formed by molding.

11. The dispensing closure of claim 9 wherein the end surface of the inner circumferential flange on the inner cap has an upper surface provided with at least one upward projection sized to be received within said at least one aperture in the end panel of said outer cap when said inner and outer caps are in a closed position, said projection including a camming surface that cooperates with an inside surface on the outer cap end panel adjacent said at least one aperture to facilitate the travel of said at least one projection into and out of said at least one aperture when said outer cap is respectively axially moved into said closed and dispensing positions.

12. The dispensing closure of claim 1 wherein the end panel of said inner cap includes an upwardly projecting closed plug and said at least one aperture formed in said inner cap end panel is spaced radially outwardly of said plug, said at least one aperture in said outer cap being positioned to receive said plug on said inner cap when said outer and inner caps are in a closed position.

13. The dispensing closure of claim 12 wherein said resilient liner is positioned so as to seal said at least one aperture in said inner cap end panel when said outer and inner caps are in a closed position.

14. The dispensing closure of claim 1 wherein the inner surface of said outer cap includes an inwardly extending annular bead and the outer surface of said inner cap includes an outwardly extending bead, said inwardly extending bead and said outwardly extending bead being axially spaced from each other when said outer and inner caps are in said closed position and being in contact with each other when said outer and inner caps are in said dispensing position.

15. The dispensing closure of claim 1 wherein the outer surface of the sidewall of the inner cap includes an outwardly extending bead which engages the inner surface of the outer cap to provide a liquid tight seal therewith.

16. The dispensing closure of claim 1 wherein the inner surface of the sidewall of the outer cap includes an inwardly extending bead which engages the outer surface of the inner cap to provide a liquid tight seal therewith.

17. A dispensing closure for a container having a cylindrical neck which terminates in an end finish that defines an open mouth, said closure comprising:

an outer cap and an inner cap, said outer cap being axially moveable with respect to said inner cap between a closed position and a dispensing position;

said outer cap including an end panel and a generally cylindrical sidewall extending downwardly therefrom, at least one aperture in said end panel forming a passage through which the contents of said container can be dispensed, said at least one aperture spaced radially outwardly of a downwardly extending cylindrical plug on a closed inside surface of said end panel;

said inner cap being adapted to be secured to said container neck and including an outer annular flange adapted to overlie the open mouth of said container, a first resilient liner on the inside surface of said outer annular flange for providing a seal with the end finish of said container, the inner portion of said outer annular flange extending into an axially projecting tubular sidewall which terminates in an inwardly extending inner circumferential flange that defines a cylindrical opening sized to surroundingly receive said plug;

a second resilient liner on at least one of said plug outer surface and said inner circumferential flange to provide a seal therebetween when the outer cap is in a closed position with respect to the inner cap; and, whereby, when said outer cap is in a dispensing position with respect to said inner cap, said plug is axially displaced from said inner circumferential flange, thereby providing a passageway for dispensing the contents of said container through the interior of the axially projecting tubular sidewall and inner circumferential flange of said inner cap, into an interior area of the outer cap surrounding said plug, and through the apertures in the end wall of said outer cap.

18. The dispensing closure of claim 17 wherein said outer cap includes an annular shoulder integral with and radially outwardly extending from a bottom portion of the cylindrical sidewall thereof, the outer periphery of said shoulder extending into an axially downwardly extending cylindrical skirt integral therewith, said skirt being dimensioned to be received in surrounding relation to the neck of said container, an inner surface of said cylindrical skirt including at least one thread.

19. The dispensing closure of claim 18 wherein the cylindrical neck of said container includes at least one thread, said at least one thread on said cylindrical skirt being dimensioned to cooperate with said at least one thread on the container neck, whereby when said outer cap is rotated in one direction, the outer cap is axially moved into said closed position and when said outer cap is rotated in an opposite direction, the outer cap is axially moved into said dispensing position.

20. The dispensing closure of claim 18 wherein said inner cap includes an integral downwardly extending cylindrical skirt dimensioned to be received in surrounding relation to the container neck interiorly of the skirt on said outer cap, the outer surface of said inner cap skirt including at least one thread which cooperates with said at least one thread on the inner surface of said outer cap skirt, whereby when said outer cap is rotated in one direction it is axially moved into said closed position and when said outer cap is rotated in an opposite direction it is axially moved into said dispensing position.

21. The dispensing closure of claim 18 wherein said container neck includes a cylindrical bead and said outer closure includes a tamper indicating band at the lowermost portion of said skirt, said tamper indicating band being joined to said skirt by a fracturable line of weakness and including an inwardly projecting portion which is adapted to be received below the cylindrical bead of the container when the closure is applied to said container, whereby axial movement of the outer cap will cause the tamper indicating band to be severed from said outer cap skirt when said outer cap is axially moved from the closed to the dispensing position.

22. The dispensing closure of claim 21 wherein said fracturable line of weakness is a plurality of circumferentially disposed fracturable bridges.

23. The dispensing closure of claim 21 wherein said fracturable line of weakness is defined by a circumferential groove.

24. The dispensing closure of claim 23 wherein said groove is formed by slitting.

25. The dispensing closure of claim 17 wherein said first resilient liner is composed of a thermoplastic elastomer.

26. The dispensing closure of claim 17 wherein said second resilient liner is composed of a thermoplastic elastomer.

27. The dispensing closure of claim 17 wherein the first and second liners are both composed of a thermoplastic elastomer.

28. The dispensing closure of claim 17 wherein said second resilient liner is on said inner circumferential flange of said inner cap.

29. The dispensing closure of claim 17 wherein said first and second liners are simultaneously formed by molding.

30. The dispensing closure of claim 17 wherein said inner cap is composed of a polyolefin and each of said inner cap and first and second liners are formed by molding.

31. The dispensing closure of claim 17 wherein the end surface of the inner circumferential flange of said inner cap has an upper surface provided with at least one upward projection sized to be received within said at least one aperture in the end panel of said outer cap when said inner and outer caps are in a closed position, said projection including a camming surface that cooperates with an inside surface on the end panel adjacent said at least one aperture to facilitate the travel of said at least one projection into and out of said at least one aperture when said outer cap is respectively axially moved into said closed and dispensing positions.

32. The dispensing closure of claim 17 wherein the inner surface of said outer cap includes an inwardly extending annular bead and the outer surface of said inner cap includes an outwardly extending bead, said inwardly extending bead and said outwardly extending bead being axially spaced from each other when said outer and inner caps are in said closed position and being in contact with each other when said outer and inner caps are in said dispensing position.

33. The dispensing closure of claim 17 wherein the outer surface of the sidewall of the inner cap includes an outwardly extending bead which engages the inner surface of the outer cap to provide a liquid tight seal therewith.

34. The dispensing closure of claim 17 wherein the inner surface of the sidewall of the outer cap includes an inwardly extending bead which engages the outer surface of the inner cap to provide a liquid tight seal therewith.

35. A dispensing closure for a container having a cylindrical neck which terminates in an end finish that defines an open mouth, said closure comprising:

an outer cap and an inner cap, said outer cap being axially moveable with respect to said inner cap between a closed position and a dispensing position;

said outer cap being composed of a moldable thermoplastic polyolefin and including an end panel and a cylindrical sidewall extending downwardly therefrom, a plurality of apertures in said end panel defining passages through which the contents of said container can be dispensed, said apertures being spaced radially outwardly of a downwardly extending cylindrical plug on a closed inside surface of said end panel, an annular shoulder integral with and radially outwardly extending from a bottom portion of the cylindrical sidewall of said outer cap, the outer periphery of said shoulder extending into an axially downwardly extending cylindrical skirt integral therewith, said skirt being dimensioned to be received in surrounding relation to the neck of said container, an inner surface of said cylindrical skirt including at least one thread;

said inner cap being composed of a moldable thermoplastic polyolefin and adapted to be secured to said container neck, said inner cap including an outer annular flange adapted to overlie the open mouth of said container, a first resilient liner composed of a moldable thermoplastic elastomer on the inside surface of said outer annular flange of said inner cap for providing a vacuum seal with the end finish of said container neck, the inner portion of said inner cap outer annular flange extending into an upwardly projecting tubular sidewall which terminates in an inwardly extending inner circumferential flange that defines a cylindrical opening sized to surroundingly receive said plug, said inner circumferential flange having an upper surface provided with a plurality of upward projections each of which is sized to be received within a corresponding aperture in the end panel of the outer cap when the inner and outer caps are in a closed position, each of said projections including a camming surface that cooperates with an inside surface on the end panel adjacent each of said apertures to facilitate the travel of said projections into and out of said apertures when said outer cap is respectively moved into said closed and dispensing positions; and, a second resilient liner composed of a moldable thermoplastic elastomer on said inner circumferential flange for providing a vacuum seal with said plug when the outer cap is in a closed position with respect to the inner cap;

whereby, when said outer cap is in a dispensing position with respect to said inner cap, said plug is axially displaced from said inner circumferential flange, thereby providing a passageway for dispensing the contents of said container through the interior of the outwardly projecting tubular sidewall and inner circumferential flange of said inner cap, into an interior area of the outer cap surrounding said plug, and through the apertures in the end wall of said outer cap.

36. The dispensing closure of claim 35 wherein said first and second resilient liners are interconnected by a continuous layer of thermoplastic elastomer which lines substantially the entire inner surface of said inner cap.

37. The dispensing closure of claim 35 wherein said first and second resilient liners are joined by at least one interconnecting flow bridge of thermoplastic elastomer, whereby both of said first and second liners are simultaneously formed in a single molding operation.

38. The dispensing closure of claim 35 wherein the cylindrical neck of the container includes at least one thread, said at least one thread on the inner surface of said cylindrical skirt being dimensioned to cooperate with said at least one thread on the container neck, whereby when said outer cap is rotated in one direction, the outer cap is axially moved into said closed position and when said outer cap is rotated in an opposite direction, the outer cap is actually moved into said dispensing position.

39. The dispensing closure of claim 35 wherein said inner cap includes an integral downwardly extending cylindrical skirt dimensioned to be received in surrounding relation to the container neck interiorly of the skirt of said outer cap, the outer surface of said inner cap including at least one thread which cooperates with said at least one thread on the inner surface of said outer cap skirt, whereby when said outer cap is rotated in one direction, it is axially moved into said closed position and when said outer cap is rotated in an opposite direction, it is axially moved into said dispensing position.

40. The dispensing closure of claim 35 wherein said container neck includes a cylindrical bead and said outer closure includes a tamper indicating band at the lowermost portion of said skirt, said tamper indicating band being joined to said skirt by a fracturable line of weakness and including an inwardly projecting portion which is adapted to be received below the cylindrical bead of the container when the closure is applied to said container, whereby axial movement of the outer cap will cause the tamper indicating band to be severed from the outer cap skirt when said outer cap is actually moved from the closed to the dispensing position.

41. The dispensing closure of claim 40 wherein said fracturable line of weakness is a plurality of circumferentially disposed fracturable bridges.

42. The dispensing closure of claim 40 wherein said fracturable line of weakness is defined by a circumferential groove.

43. The dispensing closure of claim 35 wherein the inner surface of said outer cap includes an inwardly extending annular bead and the outer surface of said inner cap includes an outwardly extending bead, said inwardly extending bead and said outwardly extending bead being axially spaced from each other when said outer and inner caps are in said closed position and being in liquid tight sealing contact with each other when said outer and inner caps are in said dispensing position.

44. The dispensing closure of claim 35 wherein the outer surface of the sidewall of the inner cap includes an outwardly extending bead which engages the inner surface of the outer cap to provide a liquid tight seal therewith.

45. The dispensing closure of claim 35 wherein the inner surface of the sidewall of the outer cap includes an inwardly extending bead which engages the outer surface of the inner cap to provide a liquid tight seal therewith.

46. A dispensing closure for a container having a cylindrical neck which terminates in an end finish that defines an open mouth, said closure comprising:

an outer cap and an inner cap, said outer cap being axially moveable with respect to said inner cap between a closed position and a dispensing position;

said outer cap including an end panel and a cylindrical sidewall extending downwardly therefrom, a generally centrally located aperture in said end panel forming a passage through which the contents of said container can be dispensed, an annular shoulder integral with and radially outwardly extending from a lower portion of said cylindrical sidewall, the outer portion of said skirt extending into a downwardly projecting cylindrical skirt, said skirt being dimensioned to be received in surrounding relation to the neck of said container, the inner surface of said cylindrical skirt including at least one thread;

said inner cap including an outer annular flange adapted to overlie the open mouth of said container, the inner portion of said outer annular flange extending into an axially projecting tubular sidewall which terminates in an upwardly extending plug having a closed end sized to be received within the aperture in the end panel of said outer cap when said inner and outer caps are in a closed position, at least one aperture in the outer annular flange of said inner cap, said at least aperture in said outer annular shoulder being spaced radially outwardly of said plug and forming a passage through which the contents of said container can be dispensed;

a first resilient liner on one of said inner and outer caps providing a seal with the end finish of said container neck; and, a second resilient liner on an inner surface of the end panel of said outer cap to provide a seal with said at least one aperture in said inner cap when the outer cap is in a closed position with respect to the inner cap;

whereby, when said outer cap is in a dispensing position with respect to said inner cap, said plug is axially displaced from said aperture in the end panel of said outer cap and said second resilient liner is axially displaced from said at least one aperture in the inner cap, thereby providing a passageway for dispensing the contents of said container through said at least one aperture in the inner cap into an interior area of the outer cap surrounding said plug and through the generally centrally located aperture in the end panel of said outer cap.

47. The dispensing closure of claim 46 wherein the cylindrical neck of said container includes at least one thread, said at least one thread on said cylindrical skirt of said outer cap being dimensioned to cooperate with said at least one thread on the container neck, whereby when said outer cap is rotated in one direction, the outer cap is axially moved into said closed position and when said outer cap is rotated in an opposite direction, the outer cap is axially moved into said dispensing position.

48. The dispensing closure of claim 46 wherein said inner cap includes an integral downwardly extending cylindrical skirt dimensioned to be received in surrounding relation to the container neck interiorly of the skirt on said outer cap, the outer surface of said inner cap skirt including at least one thread which cooperates with said at least one thread on the inner surface of said outer cap skirt, whereby when said outer cap is rotated in one direction it is axially moved into said closed position and when said outer cap is rotated in an opposite direction it is axially moved into said dispensing position.

49. The dispensing closure of claim 46 wherein said container neck includes a cylindrical bead and said outer cap includes a tamper indicating band at the lowermost portion of said outer cap skirt, said tamper indicating band being joined to said outer cap skirt by a fracturable line of weakness and including an inwardly projecting portion which is adapted to be received below the cylindrical bead of the container when the closure is applied to said container, whereby axial movement of the outer cap will cause the tamper indicating band to be severed from said outer cap skirt when said outer cap is axially moved from the closed to the dispensing position.

50. The dispensing closure of claim 49 wherein said fracturable line of weakness is a plurality of circumferentially disposed fracturable bridges.

51. The dispensing closure of claim 49 wherein said fracturable line of weakness is defined by a circumferential groove.

52. The dispensing closure of claim 51 wherein said groove is formed by slitting.

53. The dispensing closure of claim 46 wherein said first resilient liner is composed of a thermoplastic elastomer.

54. The dispensing closure of claim 46 wherein said second resilient liner is composed of a thermoplastic elastomer.

55. The dispensing closure of claim 46 wherein the first and second liners are both composed of a thermoplastic elastomer.

56. The dispensing closure of claim 46 wherein said outer cap is composed of a polyolefin and each of said outer cap and first and second resilient liners are formed by molding.

57. The dispensing closure of claim 46 wherein the inner surface of said outer cap includes an inwardly extending annular bead and the outer surface of said inner cap includes an outwardly extending bead, said inwardly extending bead and said outwardly extending bead being axially spaced from each other when said outer and inner caps are in said closed position and being in contact with each other when said outer and inner caps are in said dispensing position.

58. The dispensing closure of claim 46 wherein the outer surface of the sidewall of the inner cap includes an outwardly extending bead which engages the inner surface of the outer cap to provide a liquid tight seal therewith.

59. The dispensing closure of claim 46 wherein the inner surface of the sidewall of the outer cap includes an inwardly extending bead which engages the outer surface of the inner cap to provide a liquid tight seal therewith.

60. A dispensing closure for a container having a cylindrical neck which terminates in an end finish that defines an open mouth, said closure comprising:

an outer cap and an inner cap, said outer cap being axially moveable with respect to said inner cap between a closed position and a dispensing position;

said outer cap being composed of a moldable thermoplastic polyolefin and including an end panel and a cylindrical sidewall extending downwardly therefrom, a generally centrally located aperture in said end panel defining a passage through which the contents of said container can be dispensed, an annular shoulder integral with and radially outwardly extending from a bottom portion of the cylindrical sidewall of said outer cap, the outer periphery of said shoulder extending into an axially downwardly projecting cylindrical skirt integral therewith, said skirt being dimensioned to be received in surrounding relation to the neck of said container, an inner surface of said cylindrical skirt including at least one thread;

said inner cap being composed of a moldable thermoplastic polyolefin and adapted to be secured to the end finish of said container neck, said inner cap including an outer annular flange adapted to overlie the open mouth of said container, the inner portion of said outer annular flange extending into an upwardly projecting tubular sidewall which terminates in an upwardly extending plug having a closed end adapted to be received within the aperture in the end panel of said outer cap, the annular flange of said inner cap including a plurality of apertures spaced radially outwardly of said plug;

a first resilient liner composed of a moldable thermoplastic elastomer on the outer portion of the inside surface of the annular shoulder of said outer cap for providing a vacuum seal with the end finish of said container neck; and, a second resilient liner on an inner surface of the end panel of said outer cap, said second resilient liner being located to provide a vacuum seal with said plurality of apertures in said inner cap when said outer and inner caps are in a closed position;

whereby, when said outer cap is in a dispensing position with respect to said inner cap, said plug is axially displaced from the aperture in said outer cap, thereby providing a passageway for dispensing the contents of said container through the plurality of apertures in said inner cap into an interior area of the outer cap surrounding said plug and through the generally centrally located aperture of said outer cap.

61. The dispensing closure of claim 60 wherein the cylindrical neck of the container includes at least one thread, said at least one thread on the inner surface of said cylindrical skirt being dimensioned to cooperate with said at least one thread on the container neck, whereby when said outer cap is rotated in one direction, the outer cap is axially moved into said closed position and when said outer cap is rotated in an opposite direction, the outer cap is actually moved into said dispensing position.

62. The dispensing closure of claim 60 wherein said inner cap includes an integral downwardly extending cylindrical skirt dimensioned to be received in surrounding relation to the container neck interiorly of the skirt of said outer cap, the outer surface of said inner cap including at least one thread which cooperates with said at least one thread on the inner surface of said outer cap skirt, whereby when said outer cap is rotated in one direction, it is axially moved into said closed position and when said outer cap is rotated in an opposite direction, it is axially moved into said dispensing position.

63. The dispensing closure of claim 60 wherein said container neck includes a cylindrical bead and said outer closure includes a tamper indicating band at the lowermost portion of the skirt thereof, said tamper indicating band being joined to said skirt by a fracturable line of weakness and including an inwardly projecting portion which is adapted to be received below the cylindrical bead of the container when the closure is applied to said container, whereby axial movement of the outer cap will cause the tamper indicating band to be severed from the outer cap skirt when said outer cap is actually moved from the closed to the dispensing position.

64. The dispensing closure of claim 63 wherein said fracturable line of weakness is a plurality of circumferentially disposed fracturable bridges.

65. The dispensing closure of claim 63 wherein said fracturable line of weakness is defined by a circumferential groove.

66. The dispensing closure of claim 60 wherein the inner surface of said outer cap includes an inwardly extending annular bead and the outer surface of said inner cap includes an outwardly extending bead, said inwardly extending bead and said outwardly extending bead being axially spaced from each other when said outer and inner caps are in said closed position and being in contact with each other when said outer and inner caps are in said dispensing position.

67. The dispensing closure of claim 60 wherein the outer surface of the sidewall of the inner cap includes an outwardly extending bead which engages the inner surface of the outer cap to provide a liquid tight seal therewith.

68. The dispensing closure of claim 60 wherein the inner surface of the sidewall of the outer cap includes an inwardly extending bead which engages the outer surface of the inner cap to provide a liquid tight seal therewith.

* * * * *